United States Patent [19]

Jessen

[11] 3,984,657

[45] Oct. 5, 1976

[54] STOCK TREND INDICATOR

[76] Inventor: Preben Jessen, 297 Continental Ave., River Edge, N.J. 07661

[22] Filed: Aug. 14, 1974

[21] Appl. No.: 497,232

Related U.S. Application Data

[63] Continuation-in-part of Ser. No. 398,321, Sept. 18, 1973, abandoned.

[52] U.S. Cl. ..... 235/61 B; 33/1 C; 235/83; 235/89 R

[51] Int. Cl.[2] ..... G06G 1/14

[58] Field of Search ..... 33/1 C, 75; 235/61 B, 235/61 GM, 82, 83–85, 88, 89

[56] References Cited

UNITED STATES PATENTS

| | | | |
|---|---|---|---|
| 319,808 | 6/1885 | Freeman | 235/61 B |
| 2,078,138 | 4/1937 | Hansen | 235/61 B |
| 3,014,646 | 12/1961 | Gabriel | 235/61 GM |
| 3,535,788 | 10/1970 | Sena | 33/75 R X |
| 3,766,652 | 10/1973 | Gomez | 235/61 GM |

*Primary Examiner*—Lawrence R. Franklin

[57] ABSTRACT

A stock trend indicator and method of using is disclosed. The manipulable instrument is used with a standard stock chart to forecast an evaluation of future stock behavior.

1 Claim, 4 Drawing Figures

STOCK TREND INDICATOR

This is a continuation-in-part of my copending U.S. Pat. application Ser. No. 398,321, now abandoned.

BACKGROUND OF THE INVENTION

1. Field of the Invention

The art to which this invention pertains is found in Class 235 subclasses 82 and 83.

2. Description of the Prior Art

Stock charts are well known, and the mental evaluation of these charts is, of course, known. The use of a precisely manipulable instrument in combination with an emperical chart (i.e. stock market short) to predict future rates, prices, trends and profits is believed to be novel in the art.

SUMMARY OF THE INVENTION

Security listings and weekly charts containing quarterly earnings, etc., supply the user with a history of facts, but little information for prediction of future moves of prices, dividends, etc. A means for securing and predicting this information is achieved by this invention.

Except during periods of stock market recession and widespread lack of market confidence, stock prices over the short term follow closely the quarterly trend of earnings. Where the earning trend is particularly strong and brings in heavy demands for a stock, the price will be driven up until the demand for the stock subsides unless reinforced by an additional increase in the next quarter's earnings. Using the trend of cumulative earnings for short term predictions would defeat the prediction purpose since these cumulative earnings sum up the earnings for the past four quarters and, therefore, come approximately six months late and actually eliminate the opportunity to cash in on the volatility of price actions up or down, which is available only over a short term of three to six months, and particularly during the first few days after an important earnings change has been published. A predicted quarterly earnings trend line for the future 3 months period is constructed by plotting the three or four latest quarterly earnings on a weekly stock chart and using the price scale for earnings where practical. Where this is not practical, a separate earnings scale covering an approximate range similar to that of the price scale is plotted. A transparent calculator body with a rotatable indicator is placed over the weekly stock chart with the price as of the week when the last quarterly earnings were published. The following week is shown through a "see-through" opening of a tubular rivet. The body of the calculator has a half-circle of a radius equal to one-half the range of the price scale of the stock chart for a three-months prediction. A trend line is established similarly to that of combining of vectors of a vector diagram. This trend line favors the last two earnings over the earlier earning line trend. This trend line is then shifted and another trend line parallel to the first drawn trend line through the said price on the curve. Except in the special cases of insiders' manipulations, merger actions and the like the stock prices follow closely the earnings and therefore constitute the best available indicator of price trends, at least for a short term of three months.

After the calculator body has been centered over the stock chart as hereinafter more fully described, the rotatable indicator is moved into position over the trend line. The intersection of this positioned indicator with an inscribed half-circle establishes the desired prediction for the term of three months. This projected prediction as it follows the earnings scale shows a certain move up or down from the earning when the price prediction was done.

This move expressed as a percentage of said earning also becomes the percentage move predicted for the stock price on account of the earnings trend and without consideration of the effects of trend of the Dow index for the coming three or more months as desired. The sales volume and power and lack of power of the market confidence is expressed as percentages of the normal conditions as pertaining to the stock. The DOW and the market conditions are taken from the empirically developed standards shown on the calculator. These standards were developed through analyses of thousands of listed stocks through the years 1969 through 1972, and the empirically developed facts disclosed the need for a major adjustment of the price prediction due to earnings, namely, that when earnings turn negative, the effect on price decline is only half as strong as it is when the earnings are rising. The corresponding BASE on the calculator is therefore one-half of that shown by the indicator, which means the indicator is turned back to a percentage one-half the percentage calculated. This is due to the lack of interest on the part of the large body of brokers, traders and investors who avoid in investing in stocks with declining earnings.

The BASE is the percentage of price move due to quarterly earnings move and it is basic to every move of all percentages shown in three columns of the CALCULATOR with the exception noted above when the BASE is negative.

The predicted trend of the DOW index and curve exerts power over the stock price through its influence upon the amount of sales volume which is developed on the exchanges, and the sales volume due to strong DOW trend rising 15 percent in three months, will add from 50 to 300 percent to the stock price as the BASE rises from 20 to 80 percent, as shown on the Calculator. With a DOW trend falling to the maximum over a three month period of 15 percent and the said BASES of 20 to 80 percent the sales volume will add from 30 to 100 percent to the stock price. For declining BASES combined with declining DOW, the sales volume effect will hurt the predicted price drop with an additional drop of from 15 to 30 percent.

There has been chosen a specific embodiment of an apparatus and method for forecasting stock price movement by combining a drawn trend line applied to a stock chart with a rotatable arrow carried on a transparent calculator. This specific embodiment has been chosen for the purpose of illustration and description as shown in the accompanying drawings.

DESCRIPTION OF THE PREFERRED EMBODIMENT

Figure 1:
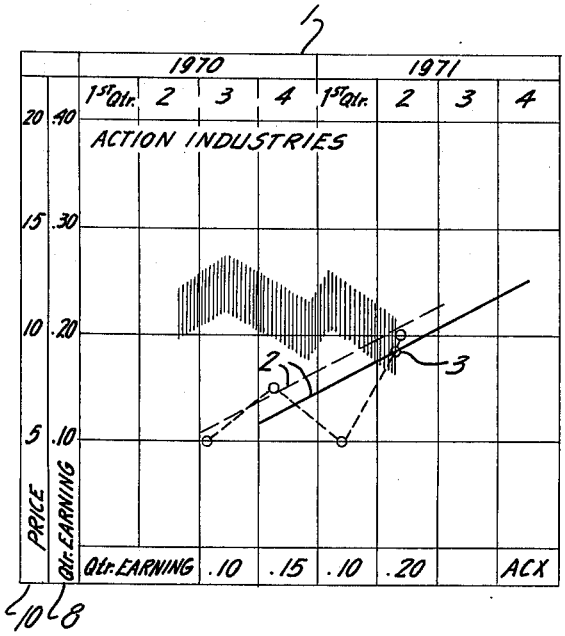
FIG. 1 represents a common weekly stock chart which includes price prediction, namely: history of monthly quarterly earnings, curve for weekly price ranges with price scale. On this chart is plotted the quarterly earnings from which a trend line for earnings and price moves is constructed.
Figure 3:
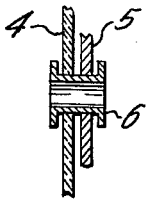
FIG. 3 is a section through the see-through tubular rivet showing the rotatable indicator mounted above the base portion.

A common weekly stock chart of the listed stock on which a prediction is to be made as to the percentage of price movement up or down is shown in FIG. 1. This chart is attached to a flat board and an earning scale similar to the price scale but of a range suitable to represent the quarterly earnings is set up on the left side of the chart and the last three of four earning periods are plotted. A trend line 2 is drawn through the plotted earnings giving slightly more weight to the last two earning periods otherwise the same as vectors of a vector diagram are combined. This line 2 is projected through the price of that week of the price chart when the latest quarterly earning was published as price 3 of FIGS. 1 and 2. As an example, the published price of the stock was $9.00.

A calculator body 4 of transparent material and carrying an indicator 5 rotatable around a tubular see-through rivet 6 is positioned against the stock chart 1. The upper and lower edges are 20 and 21 are parallel, and the see-through opening 6 is centered over the point 3.

Figure 2:
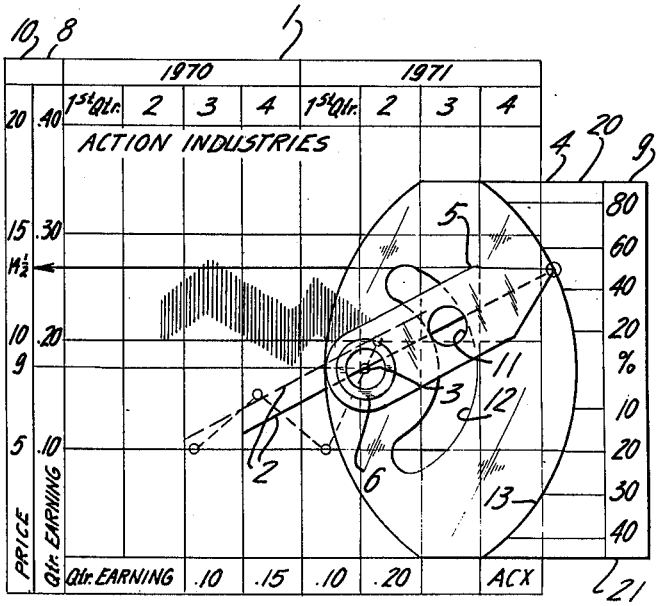
FIG. 2 shows a transparent calculator body having a rotatable indicator mounted at the left side and a percentage tabulation column at the right side. This body is shown placed over the stock chart of FIG. 1 after a trend line for earnings has been constructed by plotting of several recent quarterly earnings. This trend line is repeated in a parallel manner with this line passing through that particular week of the price curve when the latest quarterly earning was published. The rotatable indicator depicted as moved into position and in coincidence with the trend is arranged so that this line passes through the weekly price point. The see-through tubular rivet is centered over this point. The intersection of the center line of the indicator with a half circle cut out formed in the indicator is then projected against an earnings scale constructed on the left side of the weekly stock chart indicating the amount of move up or down predicted through the coming three months' period. The percentage of gain is read off the right hand column of the indicator.

The indicator 5 is now rotated into position and aligned to coincide with the trend line 2. From the point of intersection between the centerline of the indicator 5 and the half circle 6 a point is established. This circle 6 has a radius equal to the space of three quarters if the prediction is to cover three quarters of a year into the future, a horizontal line from point 7 is drawn to the price scale 10 on the left side of stock chart 1 in FIG. 2, showing a predicted increase in stock price over the next three quarters from the present $9.00 to an anticipated $14.50. This is a increase of 50 percent.

Figure 4:
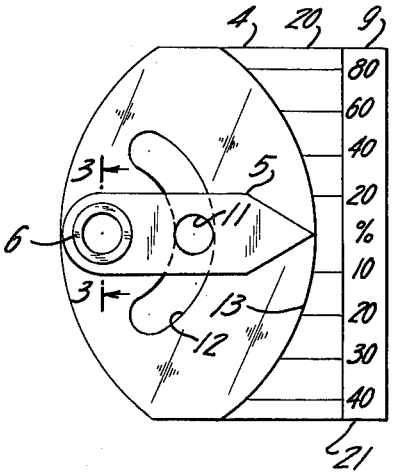
FIG. 4 represents a plan view of the portable indicator of this invention.

The intersection point 7 is also projected to the percentage scale 9 of the calculator FIG. 4, which confirms that the anticipated price increase is 50 percent.

A circular opening 11 in the indicator 5 and a segmental arcuate slot 12 in calculator body 4 having a common radius and origin point provides visibility in lining up the centerline of 5 with the trend line 2.

Terms such as "left," "right," "up," "down," "bottom," "top," and the like are applicable to the embodiment shown and described in conjunction with the drawing. These terms are merely for the purposes of description and do not necessarily apply to the position in which the stock trend indicator may be constructed or used.

While this particular embodiment has been shown and described it is to be understood the invention is not limited thereto since modifications may be made within the scope of the accompanying claims and protection is sought to the broadest extent the prior art allows.

What is claimed is:

1. A stock market trend indicator comprising:

a stock chart consisting of a graph showing the recent history of a particular stock, said chart having an abscissa consisting of a linear scale calibrated in units of time and an ordinate consisting of two linear scales calibrated in units of stock price and quarterly earnings, respectively;

data points located on said chart corresponding to at least three recent quarterly earnings;

a trend line drawn on said chart to approximate the general trend of the said recent quarterly earnings;

a calculator consisting of a base member, rotatable arm, and a see-through rivet rotatably connecting said arm to said base member;

said base member having a straight bottom edge, a top edge, and two side edges, said rivet being located substantially midway between said top and bottom edges adjacent one of said side edges;

a percentage scale located adjacent the other of said side edges, said percentage scale having (1) a zero point located on a line which passes through the center of said rivet parallel to said bottom edge, (2) a percentage increase scale located above said zero point and calibrated to correspond with the calibration of said price and said earnings scales, and (3) a percentage decrease scale located below said zero point calibrated to read one half of the percentage increase scale for equal distances from said zero point; and said arm having a length corresponding to a specific period of time as measured on said time scale and having a pointer at the end remote from said rivet, said pointer coacting with said percentage scale, whereby when said calculator is positioned on said chart with the bottom edge parallel to said abscissa, with said see-through rivet centered on said trend line at the current price of said stock, and with said pointer overlying the extension of said trend line, said pointer will indicate the anticipated percentage increase or decrease of the stock price and quarterly earnings on said percentage scale.

* * * * *